US010453285B2

(12) United States Patent
Steinmetz

(10) Patent No.: US 10,453,285 B2
(45) Date of Patent: Oct. 22, 2019

(54) CONFIGURABLE ELECTRIC WIRELESS LOCK ASSEMBLY

(71) Applicant: Barcoding, Inc., Baltimore, MD (US)

(72) Inventor: Jay Steinmetz, Baltimore, MD (US)

(73) Assignee: Barcoding, Inc., Baltimore, MD (US)

( * ) Notice: Subject to any disclaimer, the term of this patent is extended or adjusted under 35 U.S.C. 154(b) by 0 days.

(21) Appl. No.: 15/889,747

(22) Filed: Feb. 6, 2018

(65) Prior Publication Data

US 2019/0244456 A1 Aug. 8, 2019

(51) Int. Cl.
*G07C 9/00* (2006.01)

(52) U.S. Cl.
CPC ..... *G07C 9/00309* (2013.01); *G07C 9/00111* (2013.01); *G07C 9/00912* (2013.01); *G07C 2009/00634* (2013.01); *G07C 2009/00769* (2013.01)

(58) Field of Classification Search
None
See application file for complete search history.

(56) References Cited

U.S. PATENT DOCUMENTS 6,710,700 B1 * 3/2004 Tatsukawa ..... B60R 25/04 340/5.52
7,177,819 B2 * 2/2007 Muncaster ..... G06Q 50/16 340/5.73
9,547,947 B2 * 1/2017 Chou ..... G07C 9/00007
9,563,800 B2 * 2/2017 Chen ..... G06K 9/00013
9,569,904 B2 * 2/2017 Chou ..... G07C 9/00563
9,787,127 B2 * 10/2017 Shen ..... E05B 47/0012
9,876,387 B2 * 1/2018 Geiszler ..... H02J 7/025
2004/0178706 A1 * 9/2004 D'Orso ..... A47B 43/006 312/351
2009/0308116 A1 12/2009 Lambrou
2014/0002236 A1 * 1/2014 Pineau ..... G06F 21/32 340/5.6
2017/0018956 A1 * 1/2017 Geiszler ..... H02J 50/10
2017/0040827 A1 2/2017 Weber
2017/0215620 A1 * 8/2017 Dade ..... F25D 13/04
2017/0356218 A1 * 12/2017 Beasley ..... G07C 9/00896
2018/0108192 A1 * 4/2018 Ho ..... G06K 9/00288
2018/0160835 A1 * 6/2018 Garrity ..... A47G 29/141

* cited by examiner

*Primary Examiner* — Carlos Garcia
(74) *Attorney, Agent, or Firm* — Occhiuti & Rohlicek LLP

(57) ABSTRACT

Disclosed are devices, assemblies, systems, apparatus, methods, products, and other implementations, including a lock assembly to control access to an individual storage space. The lock assembly includes a wireless chargeable storage device to store energy transmitted wirelessly from a remote source, a modular support structure configured to hold the wireless chargeable storage device, and an electric lock in electrical communication with the wireless chargeable storage device. The electric lock is configured to be electrically actuated, using stored energy delivered from the wireless chargeable storage device, from a current locking state to a subsequent locking state in response to a control signal representative of a locking change state.

20 Claims, 4 Drawing Sheets

CONFIGURABLE ELECTRIC WIRELESS LOCK ASSEMBLY

BACKGROUND

Multi-compartment structures, including locker arrays (i.e., lockers with electrically actuated electric locks and/or mechanical locks) require careful planning and off-site manufacturing to meet specific customer requirements (specific dimensions). In the case of electric locks, electrical wiring overhead makes manufacturing and installation of electric lock arrays (e.g., in fitness centers, at transit centers, and other public or semi-public locations) more challenging and cumbersome.

SUMMARY

The devices, assemblies, methods, products, systems, apparatus, and other implementations described herein include a lock assembly to control access to an individual storage space. The lock assembly includes a wireless chargeable storage device to store energy transmitted wirelessly from a remote source, a modular support structure configured to hold the wireless chargeable storage device, and an electric lock in electrical communication with the wireless chargeable storage device. The electric lock is configured to be electrically actuated, using stored energy delivered from the wireless chargeable storage device, from a current locking state to a subsequent locking state in response to a control signal representative of a locking change state.

Embodiments of the lock assembly may include at least some of the features described in the present disclosure, including one or more of the following features.

The lock assembly may further include a modular door on which the electric lock is mounted, with the modular door being physically coupled to the modular support structure via a physical coupler, the physical coupler including an interfacing circuit to electrically couple the wireless chargeable storage device to the electric lock.

The modular support structure may include a modular side wall adjustably mountable at one of a plurality of locations within an inner space of a container structure to define the individual storage space bounded by the modular side wall.

The support structure may be coupled to a modular door that further bounds the individual storage space.

The lock assembly may further include a communication module to communicate with remote devices, the communication module configured to receive a communication message from at least one of the remote devices. The lock assembly may also include a controller configured to determine, based on the wireless communication message, whether the wireless communication message includes a valid access authorization to access the individual storage space, and to cause electric actuation of the electric lock in response to a determination that the received communication message includes the valid access authorization.

The controller configured to cause the electric actuation of the electric lock may be configured to cause the electric actuation of the electric lock in response to the determination that the received communication message includes the valid access authorization and a further determination that an item inside the individual storage space transmitted an RFID identification code matching an item code included in the wireless communication message from the at least one of the remote devices.

The communication module may include a wireless communication module configured to receive one or more of, for example, a wireless short-range communication signal, a wireless medium range communication signal, or a wireless long-range communication signal.

The wireless communication module may be configured to receive one or more of, for example, a Bluetooth® signal, a Bluetooth-Low-Energy® signal, an RFID signal, a ZigBee signal, a WLAN signal, and/or a WWAN signal.

The electric lock may include one or more of, for example, an electromagnetic lock operable in a fail-secure configuration, and/or an electrical strike lock operable in the fail-secure configuration.

The electric lock may include one or more of, for example, an electromagnetic lock operable in a fail-safe configuration, and/or an electrical strike lock operable in the fail-safe configuration.

In some variations, a locker unit is provided that includes multiple modular side walls that each comprises a respective wireless chargeable storage device to store energy transmitted wirelessly from one or more remote sources, and a plurality of individually controlled electric locks that are each in electrical communication with the wireless chargeable storage device of a respective one of the multiple modular side walls, with each of the plurality of the individually controlled electric locks configured to be electrically actuated, using stored energy delivered from the wireless chargeable storage device of the respective one of the multiple modular side walls, from a current locking state to a subsequent locking state in response to a respective control signal representative a locking change state. The multiple modular side walls define, in part, individually accessible storage spaces of the locker unit.

Embodiments of the locker unit may include at least some of the features described in the present disclosure, including at least some of the features described above in relation to the lock assembly, as well as one or more of the following features.

The locker unit may further include modular doors on which respective ones of the plurality of individually controlled electric locks are mounted, with the modular doors being physically coupled to respective ones of the multiple modular support structure via respective couplers, the couplers including interfacing circuits to electrically couple the wireless chargeable storage devices to the respective ones of the plurality of individually controlled electric locks.

The multiple modular support structures each may include a side wall adjustably mountable at one of a plurality of locations within an inner space of a container structure to define a respective one of the individually accessible storage spaces of the locker unit.

Each of the individually accessible storage spaces may be associated with a communication module to communicate with remote devices, the communication module configured to receive a communication message from at least one of the remote devices. Each of the individually accessible storage spaces may further be associated with a controller configured to determine, based on the wireless communication message, whether the wireless communication message includes a valid access authorization to access the respective individual storage space, and cause electric actuation of the respective one of the plurality of individually controlled electric locks in response to a determination that the received communication message includes the valid access authorization.

In some variations, a method to control access to an individual storage space is provided. The method includes mounting a modular support structure holding a wireless chargeable storage device, within an interior space of a locker unit, with the wireless chargeable storage device being configured to store energy transmitted wirelessly from a remote source. The method further includes mechanically coupling a modular door comprising an electric lock to the support structure to define the individual storage space within the interior space of the locker unit, with the coupling of the modular door to the modular support structure establishes an electrical connection between the electric lock and the wireless chargeable storage device, and electrically actuating the electric lock of the modular door, using stored energy delivered from the wireless chargeable storage device, from a current locking state to a subsequent locking state in response to a control signal representative of a locking change state.

Embodiments of the method may include at least some of the features described in the present disclosure, including at least some of the features described above in relation to the lock assembly and the locker unit, as well as one or more of the following features.

Mounting the modular support structure may include mounting a modular side wall adjustably mountable at one of a plurality of locations within the interior space of the locker unit, with the individual storage space being bounded by the modular side wall.

The method may further include receiving a wireless communication message from at least one remote device, determining whether the wireless communication message includes a valid access authorization to access the individual storage space, and electrically actuating the electric lock in response to a determination that the received wireless communication message includes to the valid access authorization.

Electrically actuating the electric lock may further include electrically actuating the electric lock further in response to a further determination that an item inside the individual storage space transmitted an RFID identification code matching an item code included with the wireless communication message from the at least one remote devices.

Receiving the wireless communication message may include receiving one or more of, for example, a Bluetooth® signal, a Bluetooth-Low-Energy® signal, an RFID signal, a ZigBee signal, a WLAN signal, and/or a WWAN signal.

Electrically actuating the electric lock of the modular door may include electrically actuating one of, for example an electromagnetic lock operable in a fail-secure configuration, an electromagnetic lock operable in a fail-safe configuration, an electrical strike lock operable in the fail-secure configuration, or an electrical strike lock operable in the fail-safe configuration.

Details of one or more implementations are set forth in the accompanying drawings and in the description below. Further features, aspects, and advantages will become apparent from the description, the drawings, and the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1:
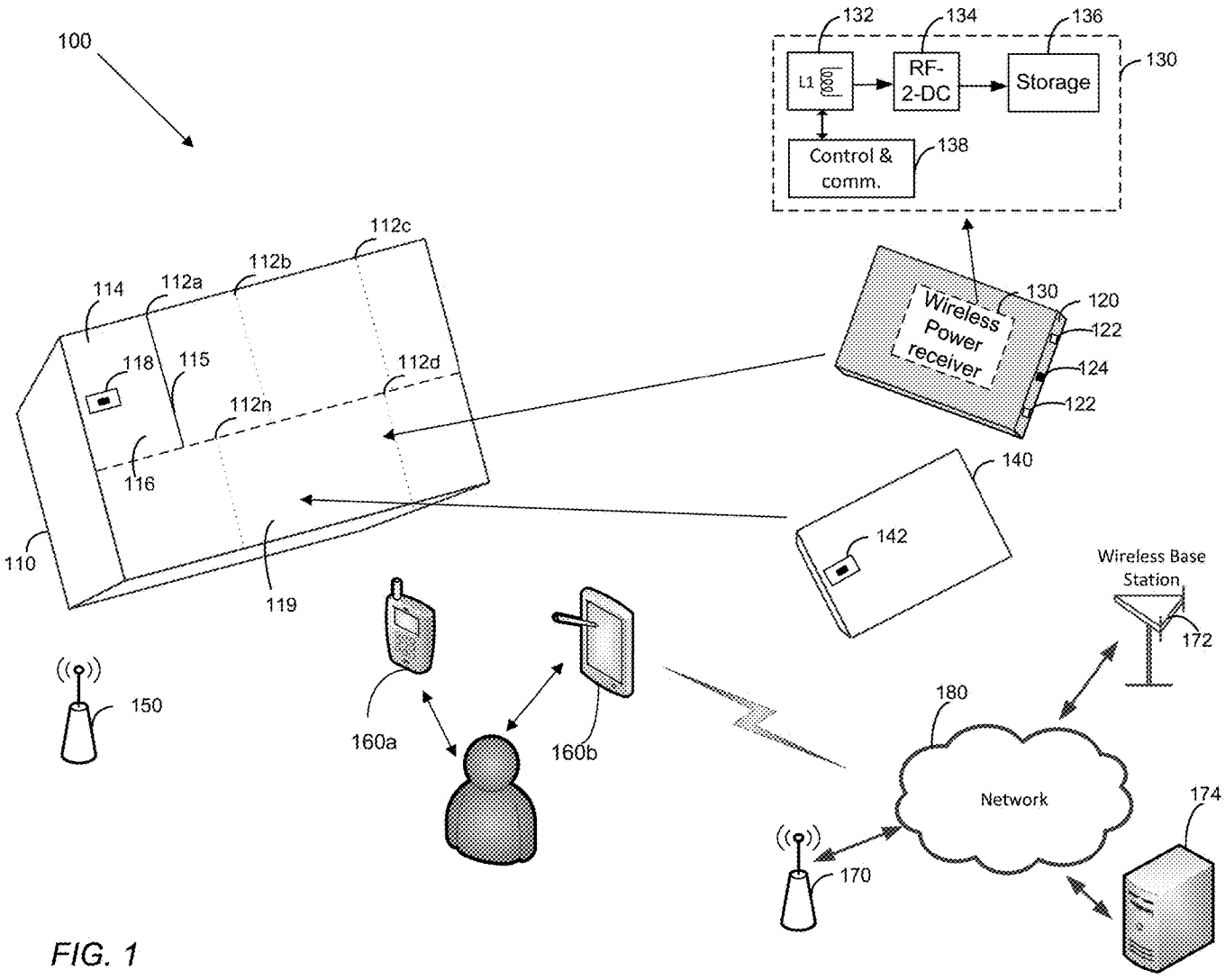
FIG. 1 is a diagram of an example system to control access to individual storage spaces.

Described herein is an electric locker (which may be part of a locker array, i.e., a catacomb of lockers, comprising multiple electric lockers) in which a modular side wall panel includes a wireless power receiver device (a wireless chargeable storage device). The wireless power receiver device may be received/mounted in an aperture defined in the side wall panel (or some other support structure supporting the wireless power receiver). The side wall can be placed at different locations within a compartment space to thus define a configurable storage space bounded by at least one or more modular side walls. The wireless power receiver mounted on the side wall provides the power to electrically lock and unlock an electric lock mounted on a modular door that also bounds the locker space. Control of the locking and unlocking operations is done wirelessly.

Thus, in some embodiments, a locker unit is provided that includes multiple side walls that each comprises a respective wireless chargeable storage device to store energy transmitted wirelessly from one or more remote sources, and a plurality of individually controlled electric locks that are each in electrical communication with the wireless chargeable storage device of a respective one of the multiple side walls, each of the plurality of the individually controlled electric locks configured to be electrically actuated, using stored energy delivered from the wireless chargeable storage device of the respective one of the multiple side walls, from a current locking state to a subsequent locking state in response to a respective control signal representative a locking change state. The multiple side walls define, in part, individually accessible storage spaces of the locker unit.

An example of an individual locker, which may be one of multiple lockers within a locker unit, comprises a lock assembly device to control access to an individual storage space, with the lock assembly including a wireless chargeable storage device (which includes one or more coils to effectuate wireless power transfer from a remote source, and a storage unit, such as a capacitor or battery) to store energy transmitted wirelessly from a remote source. The locker assembly further includes a modular support structure configured to hold the wireless chargeable storage device, and an electric lock in electrical communication with the wireless chargeable storage device, the electric lock configured to be electrically actuated, using stored energy delivered from the wireless chargeable storage device, from a current locking state to a subsequent locking state in response to a control signal representative a locking change state.

In some embodiments, the lock assembly may further include a modular door on which the electric lock is mounted, with the modular door being physically coupled to the support structure via a physical coupler, the physical coupler including an interfacing circuit to electrically couple the wireless chargeable storage device to the electric lock. The support structure may include a side wall adjustably mountable at one of a plurality of locations (e.g., into pre-defined grooves) within an inner space of a container structure to define the individual storage space bounded by the side wall. In some embodiments, the electric lock may include an electromagnetic lock or an electrical strike lock, either of which may be configured to be operable in a fail-secure or a fail-safe configuration. In some embodiments, the lock assembly may additionally include a communication module (receiver or transceiver) to communicate with remote devices (e.g., wireless personal devices) with the communication module being configured to receive a communication message from at least one of the remote devices, and a controller (e.g., processor-based) configured to determine, based on the wireless communication message, whether the wireless communication message includes a valid access authorization code (e.g., a user identification code) to access the individual storage space, and cause electric actuation of the electric lock in response to a determination that the received communication message includes the valid access authorization. The communication module may be housed within the wireless chargeable storage device, the electric lock, or elsewhere within the assembly.

Thus, with reference to FIG. 1, a diagram of an example system 100 that includes a configurable lock array 110 comprising multiple assemblies of modular wall structures, doors, etc., that can be assembled according to customized configuration to allow flexibility of construction and assembly (in terms of number, dimensions, and control of individual locker units within the array). In the embodiments depicted in FIG. 1, a rectangular cabinet-like structure 110 is provided on which modular walls (support structures) and modular doors can be mounted in a customized/configurable manner. For example, the cabinet-like structure 110 may initially be provided as a container that is open in at least one end (e.g., the front end) to define an interior area in which individual lockers can be assembled. The cabinet-like structure may include grooves (into which sides of the modular walls can be fitted) or other types of mounting structures (e.g., brackets to which the modular walls can be secured by mechanical means). The installer (a technician or a user) can select modular parts (doors, walls, or other modular structures that may be used to assemble the lockers) from a collection or inventory of parts of different sizes, dimensions, materials, colors, styles, powering capabilities, locking mechanisms (e.g., electric or mechanical locks), etc. For example, in FIG. 1, a locker 114 has been assembled into the structure 110 by mounting a modular wall 115 into a groove or a rail 112*a* (schematically represented by a line) that is selected from a plurality of grooves or rails/tracks that are provided in one of the surfaces facing the interior of the structure 110 (e.g., on the floor of the structure 110, shelves mounted in the structure, the back wall of the structure 110, or elsewhere in the structure 110). A modular door 116 with an electric lock 118 can then be mounted by mechanically securing the door 116 to a mechanical coupling interface (such as the interfaces 122 shown with respect to an example modular wall 120 in FIG. 1). The particular door 116 is selected to fit the dimensions defined by placing the modular wall 115 into the groove or track 112*a*. Had a locker space with bigger dimensions been desired, the modular wall could have been fitted into the groove 112*b*, and a larger door (with larger length than that shown in FIG. 1) could have been selected from the inventory of modular doors that the installer may have in his/her disposal. It is noted that, in some embodiments, other modular parts, such as ceiling walls, back walls, etc., may be used to define locker spaces (or spaces for other purposes) in the structure 110.

In some embodiments, to implement or construct a locker comprising an electric lock that can be powered, actuated, and/or controlled based on a wireless power storage mechanism, a modular structure 120 (in this example, a wall) that includes a wireless power receiver 130, may be used in the assembly of an individual locker (e.g., for a locker space 119 illustrated in FIG. 1). The wireless power received 130 can be fitted directly into an interior portion of the wall 120 (or the interior portion of some other support structure holding the wireless power receiver). Alternatively, the wireless power receiver can be mounted on an exterior surface of the modular wall 120, to a cavity defined in the modular wall 120 (e.g., a bore or opening into which, for example, a cylindrically-shaped housing, or other housing shape, holding circuitry to realize the wireless power receiver, can be fitted).

The wireless power receiver 130 may be configured to receive electromagnetic (e.g., RF) transmissions from, for example, a high power wireless transmitter 150 configured to transmit strong RF signals at a frequency compatible with the receiving circuit of the various modular walls (and/or other parts) used in assembly of the lockers, and to harvest the energy of the received electromagnetic transmissions. The RF power transmitted by the transmitter 150 may also be used to charge chargeable items deposited within the storage space defined by the modular devices. In some variations, power harvested by harvesting circuits of the modular parts may be used not only to actuate electric locks controlled by such circuits (as will be described in greater detail below), but also to direct such stored energy to various chargeable devices deposited inside the locker (e.g., via charging ports, such as USB ports, provided in the modular parts). Additionally, the transmitter 150, or other transmitters within communication range(s) of the locker (the communication ranges may depend on the particular communication protocols used) may be able to communicate (data and control signals) with one or more of the items deposited within the various individual storage spaces (e.g., if such items comprise appropriate communication circuitry).

A wireless power receiver generally includes an RF transducer circuit to receive RF transmissions, with such a circuit comprising one or more coils, such as a coil 132 (also referred to as an antenna element). In some embodiments, the power receiving functionality may be implemented, at least in party, using capacitance elements (rather than based entirely, or partially, on inductive elements such as the coil 132). The coil 132 is coupled to an RF-to-DC conversion circuit 134 (e.g., an RF-to-DC rectifier) that may also be configured to process or condition the resultant DC current (e.g., through further filtering and/or down-conversion operation to a lower voltage level). The DC output of the RF-to-DC converter is provided to a storage device 136 realized, for example, as a capacitor(s), a battery, etc.

In some embodiments, the wireless power receiver may also include a control and communication module 138 configured to establish and communicate data and control signaling via a communication channel between the wireless power receiver 130 and a transmitter (e.g., the transmitter 150 in the example of FIG. 1 and/or a wireless device such devices 160*a* or 160*b* communicating messages to open or lock a particular locker). The exchange of data and control signaling may be performed either through the same channel through which RF power is transmitted (e.g., in-band communication, which can be implemented through modulation of data on the carrier high RF power signal received by the wireless power receiver 130), or via a separate communication channel (out-band channel such as a WiFi-based channel, a long-range cellular channel, a near-range channel such as Bluetooth, Bluetooth Low Energy, ZigBee, etc.) Control functionality of the wireless power receiver 130 may include a tuner adjustment (e.g., impedance matching) capability, e.g., to controllably adjust a resonant frequency of the transducer 132 to more efficiently receive and convert power transmitted from the transmitter 150. The tuner adjustment may be based on data measurement performed at the wireless power receiver 130 (e.g., measuring the frequency, and/or other signal characteristics of received RF signals) and/or based on information transmitted from the transmitter 150 (or from some other device) through an in-band communication channel or an out-band communication channel (e.g., information indicating lack of impedance matching between the receiver and transmitter, if, for example, the transmitter detects that some of the power transmitted is reflected back).

In some embodiments, the control and communication module 138 may also be configured to determine if power transmitted from a powering transmitter such as the transmitter 150 is intended to charge the particular locker in which the particular modular wall is installed. For example, the modular wall 120 (or, rather, the wireless power receiver 130 associated therewith) may be assigned a particular identifier or access code. Power charging operations may be permitted, in some implementations, when the transmitter 150 includes with its charging RF transmissions (e.g., through in-band or out-band communication) the particular identifier associated with the particular modular wall. To enhance security features of the wireless power transfer performed by the system 100, communications between the transmitter and wireless power receiver may be encrypted and/or signed to authenticate the source of the transmission. In some embodiments, the transmitter (node) 150 may also be configured to send control data to the control and communication module associated with various lockers assembled within the structure 110. For example, the transmitter 150 may be configured to transmit (according to near-range, mid-range, or far-range communication protocols) identification data and/or access codes for the different lockers (e.g., after a user has completed a transaction to rent locker space for some period of time). The data transmitted by the transmitter 150 may include related data, such as duration or expiry time associated with the locker space rental, and other germane data.

Thus, to assemble a locker (within a structure such as the structure 110) the installer (or even a user that is to use the locker) determines desired dimensions (from a set of available dimensions), and picks from the inventory of modular walls and doors appropriately sized walls and parts (e.g., picks a door 140 with dimensions compatible with the desired dimension, and a wall, such as the wall 120, that is compatible with, and can be coupled to, the selected door 140. The selected modular wall (which may include an associated wireless power receiver such as the receiver 130) is slid into a pre-defined groove or a pre-installed track (or otherwise slid into some other type of mounting mechanism), and may be secured to other pre-existing or pre-installed walls within the structure 110. Alternatively, the wall 120 may be placed into any location available in the structure 110, and secured into a pre-existing part of the structure via fastening mechanisms (e.g., screws, bolts, magnets, etc.) The selected modular door 140 is fastened or otherwise mechanically secured to the mechanical coupling interfaces 122 (e.g., which may include locking mechanical latches, brackets to which the door can be secured, etc.) For example, in some implementations, modular doors may optionally be configured to be slide-locked into a wall bracket (e.g., into brackets that may be adapted to function as plastic squeeze buckles). In some variations, the inventory of modular parts may include modular locks (e.g., modular electric locks, modular mechanical locks) that can be latched or locked into brackets provided on the doors.

In some embodiments, some of the modular walls and doors used may be equipped with RFID tags (active or passive) that can transmit information to a reader (e.g., in a UHF band) in response to detecting a probing signal (which may also be a UHF-band signal, or some other type of signal) that can uniquely identify the RFID tag, and thus the modular part (wall or door) associated therewith. Transmissions sent by such tags may include additional information (specific modular part, part characteristics, etc.) The probing or request signal may be sent by the reader device, or some other device (e.g., the transmitter 150). It is noted that items places within the various storage spaces may also be provided with RFID tags that can be used to track those items.

In some embodiments, assembly of lockers may be an ongoing process, with the allocation of physical space changing over time. For example, a user wishing to obtain storage space may be provided with a modular wall(s) and a door having dimensions that allow assembly of a locker that occupies the desired space size. The user would then look for unoccupied space in the structure 100, and slide the modular wall(s) the user received into unoccupied grooves or tracks, and fasten the door to the walls to complete assembly of the locker (in some situations, one of the walls may have been a previously installed modular wall that was used to assemble a neighboring locker). The user may subsequently control access to the storage/locker space using, for example, the user's wireless device (by communicating to a communication module included in either an electric lock on the door, or within a wireless power receiver of one of the walls).

The door 140 includes a lock 142, which, in some embodiments, may be an electric lock (alternatively, the lock may be a mechanical lock actuated by a key). The electric lock may be electrically controlled (e.g., actuated) by a controller inside a housing covering the electrical locking mechanism (the locking mechanism is not specifically shown in FIG. 1) or by the control and communication module 138 of the wireless power receiver 130 attached or contained with the modular wall 120. The locking mechanism is actuated from one locking state (e.g., locked) to another locking state (unlocked), or vice versa, in response to receiving an actuation signal. In embodiments in which the modular door 140 includes an electric lock that is actuated using power delivered from a wireless power receiver device (such as the receiver 130 of the modular wall 120), an electrical interface 124 provided on the modular wall 120 (e.g., on the side surface that is mechanically fastened to the door 140, as illustrated in FIG. 1) may engage a complimentary interface located on the door 140 that allows the establishment of an electrical connection from the energy storage device 136 of the wireless power receiver 130 to the electric lock 142 of the door 140. The electrical interface may also provide further mechanical coupling between the modular door and modular side wall. In some embodiments, the circuitry implemented for the electric lock on a modular door may already include a wireless power storage circuit that can be charged by a remote wireless power source to store energy needed to actuate the electric lock on the modular door.

In some embodiments, the lock 142 may include one or more of, for example, an electromagnetic lock (implemented based on an arrangement of an electromagnetic strip and an armature), an electrical-strike lock (with a displaceable mechanical locking component, such as a bolt, that moves, e.g., using an electrical motor or some other displacement mechanism, in response to electrical actuation), etc. The lock 142 mechanism may be implemented in a fail-secure configuration, in which when electrical power is not delivered to the lock mechanism, the lock mechanism will be in a locked state lock. Thus, for example, in response to a determination that a valid access authorization code has been provided (i.e., it matches a previously stored access authorization code), power may briefly be delivered to the lock 142 to actuate the lock mechanism, e.g., electromagnetically, or electro-mechanically (for example, using an electrical motor) and cause the lock 142 to be unlocked. In such embodiments, when no power is delivered to the lock mechanism comprising the electric lock, the lock mechanism will remain locked. Alternatively, in some embodiments, a lock mechanism comprising the electric lock 142 may be implemented in a fail-safe configuration, in which power delivery causes lock mechanism to be in a locked state, and termination of power delivery causes the lock mechanism to unlock.

In operation, an actuation signal to electrically actuate an electric lock such as the lock 142 may be generated in response to a determination that a communication message transmitted from a wireless device associated with a user (e.g., a wireless personal phone 160*a* or a tablet device 160*b*) includes data that matches a pre-programmed data stored in a memory device of the controller controlling the electric lock actuation. For example, when the locker was installed (or an already installed locker is assigned to a particular user on a permanent or temporary basis), a pre-stored access authorization code (e.g., an identification code associated with a particular user) is assigned and stored at a memory device coupled to the controller. A user wishing to subsequently access the electric lock transmits a wireless message (configured according to WiFi-based protocol, an active or passive radio-frequency identification (RFID) protocol, a Bluetooth-Low-Energy® (BLE) protocol, Bluetooth®, or any other communication protocol that a communication module is adapted to use) that includes a previously generated or assigned identification code. If the controller of the electric lock determines that its stored access authorization code matches the code included in the wireless message (through comparison of a decoded value decoded from the wireless message, and the stored code), the controller will electrically actuate the electric lock to cause the lock to change its locking state (e.g., be unlocked if the lock was previously locked, or be locked of the lock was previously unlocked). For example, in response to a determination that the decoded access code and the stored access code match, the controller of the wireless power receiver (or of the electric lock) will cause electrical current to be directed from the power storage device 136 to the locking mechanism to actuate the electric lock.

In some variations, the decisions of whether to actuate the locking mechanism from a first state to a second state (e.g., from a locked to an unlocked state) may further be based on additional factors. For example, generating an actuation signal may be based on a determination that location data provided through the wireless message (e.g., location data that is determined based on multilateration position determination procedures) approximately matches the location of the locker (e.g., to avoid remote opening of a locker unit). Additionally, generating an actuation signal, in order to control access to a locker assembled using modular walls and doors such as wall 120 and the door 140, may also be based on a determination that various measured properties (e.g., corresponding to various environmental conditions such as temperature, humidity, detection of motion, etc.) match expected or permissible values. Other examples of data that may be used to control the locking or unlocking of an electric lock (such as the lock 142) are provided in U.S. application Ser. No. 15/299,663, entitled "A Lock/Seal Mechanism Controllable Using Environmental Measurements," the content of which is incorporated herein by reference in its entirety.

In some implementations, actuation of the locking mechanism may also be based on whether a locker contains previously deposited items. For example, items may be tracked using RFID tags. A locked door of a particular locker space may thus be unlocked in response to a determination that the item held in the locker space corresponds to an identification number that may be provided in a wireless transmission sent to a communication module associated with the locker. Such a determination may be performed by reading the tag of which item (if any) is inside the locker (by sending an RFID probe signal using a an RFID circuit that may implemented, for example, as part of the wireless power receiver 130 associated with the modular wall used to assemble the particular locker), and determining if the identification value read by the reader (in response to the probe signal) matches an identification value provided through the wireless transmission sent by a user to actuate the locker. The determination of whether the particular item is insider the locker space may be done in addition to, or instead of, other determinations that control the actuation of an electric lock of the door (e.g., in addition to determining if access authorization codes match).

Wireless signals transmitted, by a user's wireless device or by some other remote device, to a communication module used for a locker in order to control access to the locker, may need to be authenticated (e.g., signing content of transmissions from the remote device with a secret symmetric cryptographic key that is also provided to the lock device, or alternatively, signing the transmission with a private key of an asymmetric private-public key pair). If authenticated, the received data and/or control signals may be acted upon. Authentication may be performed by applying a validation function (e.g., hash function such as SHA-0, SHA-256, or any other appropriate validation function) to a payload of a message to be transmitted, and encrypting the resultant validation results with a secret key available at the authenticating device (e.g., a private key of a private-public cryptographic key pair). The encrypted record is included with the message comprising the payload to be transmitted (e.g., measurement data, or actuation signal, as well as any required control signaling) and transmitted to the lock device. The controller controlling access to a locker or storage space may then decrypt the encrypted record, and independently apply the same validation function to the payload. If the decrypted message and the independent hash result match, this may be indicative that the message was received from a legitimate source (i.e., a source using the correct secret key).

As noted, a user may be able to control access to an individual locker unit via the user's wireless device, such as the tablet-type device 160*b* (such as an iPad™), the personal mobile telephone device 160*a*, a lap-top (which may be portable), or any other device equipped with a wireless communication module that can establish a communication channel with the electric lock 142 or with the wireless power receiver 130 that is in electrical communication with the electric lock. The wireless devices 160*a* and/or 160*b* may themselves be in communication with any type of remote network node, including WLAN nodes, such as WLAN node 170, one or more WWAN nodes, such as the WWAN node 172, and so on. Any of the depicted devices and nodes of system 100 may be elements in various types of communications networks, including a wide area wireless network (WWAN), a wireless local area network (WLAN), a wireless personal area network (WPAN), and so on. A WWAN may be a Code Division Multiple Access (CDMA) network, a Time Division Multiple Access (TDMA) network, a Frequency Division Multiple Access (FDMA) network, an Orthogonal Frequency Division Multiple Access (OFDMA) network, a Single-Carrier Frequency Division Multiple Access (SC-FDMA) network, a WiMax (IEEE 802.16), and so on. A CDMA network may implement one or more radio access technologies (RATs) such as cdma2000, Wideband-CDMA (W-CDMA), and so on. Cdma2000 includes IS-95, IS-2000, and/or IS-856 standards. A TDMA network may implement Global System for Mobile Communications (GSM), Digital Advanced Mobile Phone System (D-AMPS), or some other RAT. A WLAN may include, for example, an IEEE 802.11x network. A WPAN may include, for example, a Bluetooth network (including one based on Bluetooth Low Energy protocol), an IEEE 802.15x, RDID-based networks, other near-field communication networks, etc. In some embodiments, 4G networks, Long Term Evolution ("LTE") networks, Advanced LTE networks, Ultra Mobile Broadband (UMB) networks, and all other types of cellular and/or wireless communications networks may also be implemented and used with the systems, methods, and other implementations described herein. While the example illustrated in FIG. 1 includes a single wireless base station and a single WLAN node, in other implementations the network environment or system illustrated in FIG. 1 may include more or fewer than the nodes 170 and/or 172 which have coverage areas that may overlap at least in part. In some embodiments, the network environment of the system 100 may include no wireless base stations or access points. In some variations, communication between any of the devices 160*a-b* and a remote system may be implemented based on any combination of the WWAN, WLAN and/or the WPAN described herein.

The example system 100 of FIG. 1 may further include a server 174 (e.g., a locker assignment server or a security administrator server to control use of lockers) configured to communicate via a network 180 (which may be a packet-based network, such as the public Internet), or via wireless transceivers included with the server 174, with multiple network elements or nodes, and/or with other mobile wireless devices. For example, the server 174 may be configured to establish communication links with one or more of the nodes (e.g., the nodes 170 and 172 of FIG. 1, as well as the transmitter/node 150 that is used to wirelessly charge and communicate with individual lockers assembled in the structure 110), which may be part of the network 180, to communicate data and/or control signals to those nodes, and receive data and/or control signals from the nodes. Each of the nodes 170 and/or 172 can, in turn, establish communication links with communication modules included in the structure 110 system (e.g., via the node 150, or directly). The server 174 may also be configured to communicate directly with the communication modules of the structure 110 or with any of the mobile devices 160*a-b*. The server 174 may be configured to control access to various lockers by assigning access authorization codes to a requesting user (who may do so via an application, running on the user's wireless device, to complete a transaction to purchase or rent access to a locker) and to the locker being sold or rented. In some embodiments, the server 174 may also be configured to perform some of the locker access control operations described herein, including determine if a user possesses a valid access authorization code, whether certain conditions have been met before a lock for a particular locker can be unlocked, sending communication messages to the communication modules of individual lockers to provide actuation or control signals, etc. In some embodiments, the server 174 may be implemented as a pay station situated near the structure 110, and connected thereto via wired or wireless links.

Figure 2:
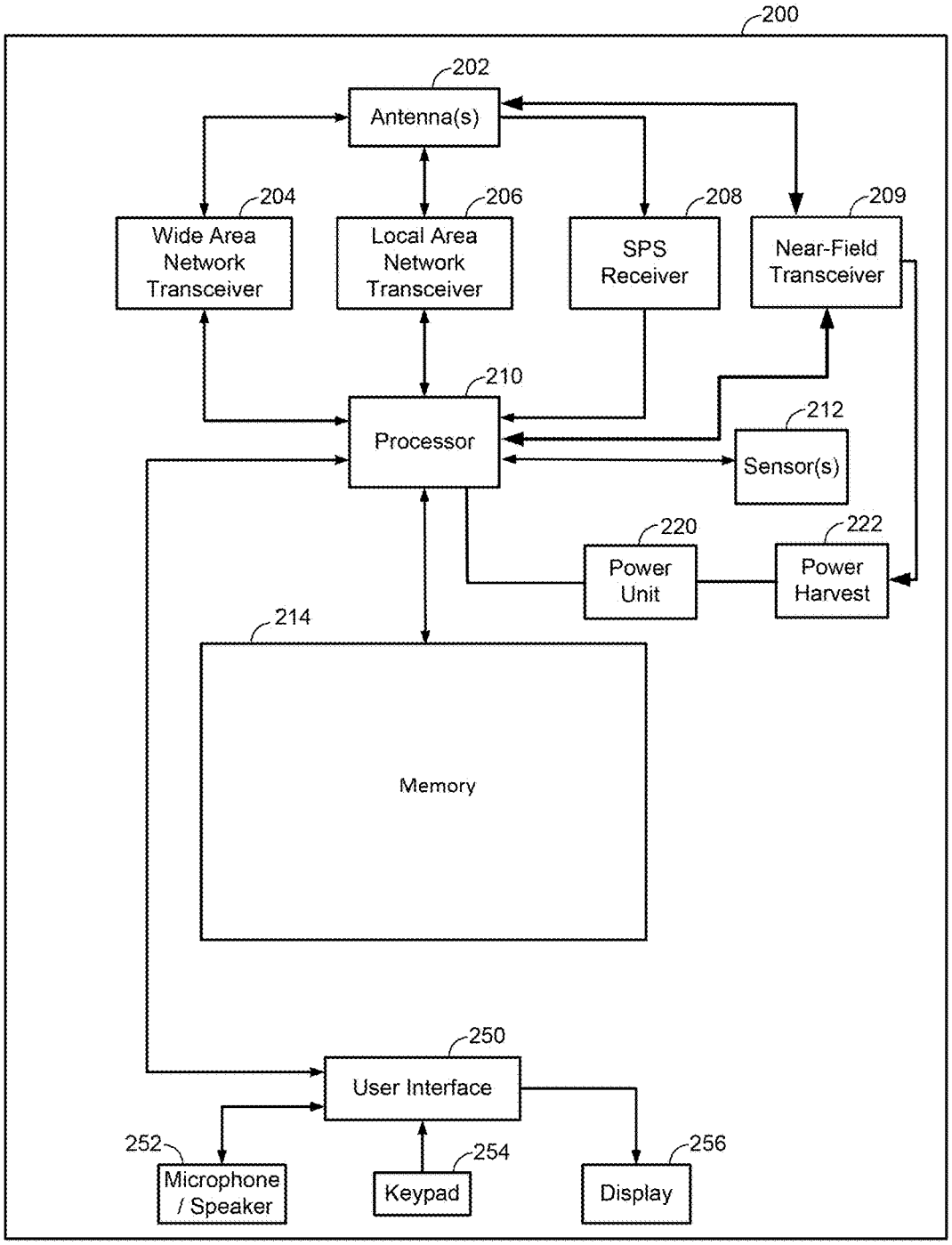
FIG. 2 is a schematic diagram of an example controller-based device that may be used to implement any one of the devices and nodes of FIG. 1.

With reference now to FIG. 2, a schematic diagram of an example device 200, which may be similar to, and be configured to have a functionality similar to that, of controllers used with modular walls (e.g., such as the controller and communication module 138), a controller that may be included with an electric lock installed on a modular door (a lock such as the lock 142), nodes 150, 170, and 172, a server 174, an RFID reader, and/or any other type of controller-based device that is used in conjunction with the system 100 of FIG. 1, is shown. It is to be noted that one or more of the modules and/or functions illustrated in the example of FIG. 2 may be further subdivided, or two or more of the modules or functions illustrated in FIG. 2 may be combined. Additionally, one or more of the modules or functions illustrated in FIG. 2 may be excluded.

As shown, the example device 200 may include one or more transceivers (e.g., a LAN transceiver 206, a WLAN transceiver 204, a near-field transceiver 209, etc.) that may be connected to one or more antennas 202. The transceivers 204, and 206, and/or 209 may comprise suitable devices, hardware, and/or software for communicating with and/or detecting signals to/from a network or remote devices (such as devices/nodes depicted in FIG. 1) and/or directly with other wireless devices within a network. In some embodiments, by way of example only, the transceiver 206 may support wireless LAN communication (e.g., WLAN, such as WiFi-based communications) to thus cause the device 200 to be part of a WLAN implemented as an IEEE 802.11x network. In some embodiments, the transceiver 204 may support the device 200 to communicate with one or more cellular access points (also referred to as a base station) used in implementations of Wide Area Network Wireless Access Points (WAN-WAP), which may be used for wireless voice and/or data communication. A wireless wide area network (WWAN) may be part of a Code Division Multiple Access (CDMA) network, a Time Division Multiple Access (TDMA) network, a Frequency Division Multiple Access (FDMA) network, an Orthogonal Frequency Division Multiple Access (OFDMA) network, a Single-Carrier Frequency Division Multiple Access (SC-FDMA) network, a WiMax (IEEE 802.16), and so on. As noted, a CDMA network may implement one or more radio access technologies (RATs) such as cdma2000, Wideband-CDMA (W-CDMA), and so on. Cdma2000 includes IS-95, IS-2000, and/or IS-856 standards, and a TDMA network may implement Global System for Mobile Communications (GSM), Digital Advanced Mobile Phone System (D-AMPS), or some other RAT.

As described herein, in some variations, the device 200 may also include a near-field transceiver (interface) configured to allow the device 200 to communicate according to one or more near-field communication protocols, such as, for example, Ultra Wide Band, ZigBee, wireless USB, Bluetooth® (classical Bluetooth), Bluetooth-Low-Energy® (BLE) protocol, etc. When the device on which a near-field interface is included is configured to only receive near-field transmissions, the transceiver 209 may be a receiver and may be not capable of transmitting near-field communications.

As further illustrated in FIG. 2, in some embodiments, an SPS receiver 208 may also be included in the device 200. The SPS receiver 208 may be connected to the one or more antennas 202 for receiving satellite signals. The SPS receiver 208 may comprise any suitable hardware and/or software for receiving and processing SPS signals. The SPS receiver 208 may request information as appropriate from the other systems, and may perform the computations necessary to determine the device's 200 position using, in part, measurements obtained by any suitable SPS procedure. Such positioning information may be used, for example, to determine the location and motion of the lock device, and to control actuation of the lock device. Additionally and/or alternatively, the device 200 may derive positioning information based on signals communicated to and from access points (and/or base stations), e.g., by performing multilateration position determination procedures based on metrics derived from the communicated signals. Such metrics from which the device 200's position may be determined include, for example, timing measurements (using techniques based on round trip time, or RTT, measurements, observed-time-difference-of-arrival, or OTDOA, in which a mobile device measures time differences in received signals from a plurality of network nodes, and so on), signal-strength measurements (e.g., received signal strength indication, or RSSI, measurements, which provide a representation of signal power level of a signal received by an antenna of the mobile device), etc.

In some embodiments, one or more sensors 212 may be coupled to a processor 210 to provide data that includes relative movement and/or orientation information which is independent of motion data derived from signals received by, for example, the transceivers 204, 206, and/or 209, and the SPS receiver 208. By way of example but not limitation, sensors 212 may utilize an accelerometer (e.g., a MEMS device), a gyroscope, a geomagnetic sensor (e.g., a compass), and/or any other type of sensor. Moreover, sensor 212 may include a plurality of different types of devices and combine their outputs in order to provide motion information. The one or more sensors 212 may further include an altimeter (e.g., a barometric pressure altimeter), a thermometer (e.g., a thermistor), an audio sensor (e.g., a microphone), a camera or some other type of optical sensors (e.g., a charge-couple device (CCD)-type camera, a CMOS-based image sensor, etc., which may produce still or moving images that may be displayed on a user interface device, and that may be further used to determine an ambient level of illumination and/or information related to colors and existence and levels of UV and/or infra-red illumination), and/or other types of sensors.

The output of the one or more sensors 212 may provide additional data about the environment in which any of the devices/nodes of FIG. 1 are located, and such data may be used to perform control operations in relation to actuation of electric locks used in conjunction with the systems and other implementations described herein. For example, location information, motion, information, temperature information, etc., may be compared to a pre-determined (and pre-stored) respective data. In such embodiments, a decision as to whether or not to unlock or lock an electric lock may be based, at least in part, on the discrepancy between the measured data and the pre-stored data.

With continued reference to FIG. 2, the device 200 may include a power unit 220 such as a battery and/or a power conversion module that receives and regulates power from an outside source (e.g., AC power, in situations where the device 200 is used to implement a mobile or stationary device to control a lock device). In some embodiments, e.g., when the device 200 is used to implement a lock device which may not have readily available access to replacement power (e.g., replacement batteries) or AC power, the power source 220 may be connected to a power harvest unit 222. The power harvest unit 222 may be implemented, at least partly, similarly to the wireless power receiver 130 depicted in FIG. 1, and may be configured to receive RF communications, and harvest the energy of the received electromagnetic transmissions (although FIG. 2 illustrates the unit 222 receiving RF communication via the near-field interface 209, the power harvest unit 222 may be connected to, and receive RF energy from, any of the other communication interfaces depicted in FIG. 2). An RF harvest unit generally includes an RF transducer circuit to receive RF transmissions, coupled to an RF-to-DC conversion circuit (e.g., an RF-to-DC rectifier). Resultant DC current may be further conditioned (e.g., through further filtering and/or down-conversion operation to a lower voltage level), and provided to a storage device realized, for example, on the power unit 220 (e.g., capacitor(s), a battery, etc.)

The processor (also referred to as a controller) 210 may be connected to the transceivers 204 and/or 206, the SPS receiver 208 and the motion sensor 212. The processor may include one or more microprocessors, microcontrollers, and/or digital signal processors that provide processing functions, as well as other calculation and control functionality. The processor 210 may also include memory 214 for storing data and software instructions for executing programmed functionality within the device.

The functionality implemented via software may depend on the particular device at which the memory 214 is housed, and the particular configuration of the device and/or the devices with which it is to communicate. For example, if the device 200 is used to implement a modular locker part (e.g., a modular door that, when assembled, is connected to a modular wall), the device may be configured (via software modules/applications provided on the memory 214) to implement a process to receive actuation signals from a remote device, authenticate the actuation signal, and then cause (e.g., using power available at the power unit 220, or using power harvested from the received actuation signals and/or ambient RF radiation received at the lock device) actuation of a lock mechanism. In some embodiments, the controller housed in either a modular door or a modular side wall may be configured to electrically actuate an electric lock of a modular door, using stored energy delivered from a wireless chargeable storage device (which may be housed in the modular door, a modular wall, or housed in some other part used in the assembly of the locker) from a current locking state (e.g., locked or unlocked) to a subsequent locking state (e.g., unlocked or locked) in response to a control signal indicating a locking change state. The memory 214 may be on-board the processor 210 (e.g., within the same IC package), and/or the memory may be external memory to the processor and functionally coupled over a data bus. Further details regarding example embodiments of a processor or computation system, which may be similar to that of the processor 210, are provided below in relation to FIG. 4.

The example device 200 may further include a user interface 250 which provides any suitable interface systems, such as a microphone/speaker 252, keypad 254, and display 256 that allows user interaction with the mobile device 200. A user interface, be it an audiovisual interface (e.g., a display and speakers) of a smartphone such as the smartphone **160*a* of FIG. 1, a tablet-based device such as the tablet-based device 160***b*, or some other type of interface (visual-only, audio-only, tactile, etc.), are configured to provide status data, alert data, and so on, to a user using the particular device 200. The microphone/speaker 252 provides for voice communication functionality, the keypad 254 includes suitable buttons for user input, the display 256 includes any suitable display, such as, for example, a backlit LCD display, and may further include a touch screen display for additional user input modes. In some embodiments, the display 256 may be a bi-state display configured to maintain (i.e., without requiring on-going supply of energy) the display of particular data (e.g., characters and/or graphics) until the state (i.e., the data) for the bi-state display is changed/updated again. Further details regarding use of a bi-state display for some implementations of the device 200 are provided, for example, in U.S. Pat. No. 8,616,457, entitled "RFID display label for battery packs," the content of which is incorporated herein by reference in its entirety. The microphone/speaker 252 may also include or be coupled to a speech synthesizer (e.g., a text-to-speech module) that can convert text data to audio speech so that the user can receive audio notifications. Such a speech synthesizer may be a separate module, or may be integrally coupled to the microphone/speaker 252 or to the controller 210 of the device of FIG. 2.

Figure 3:
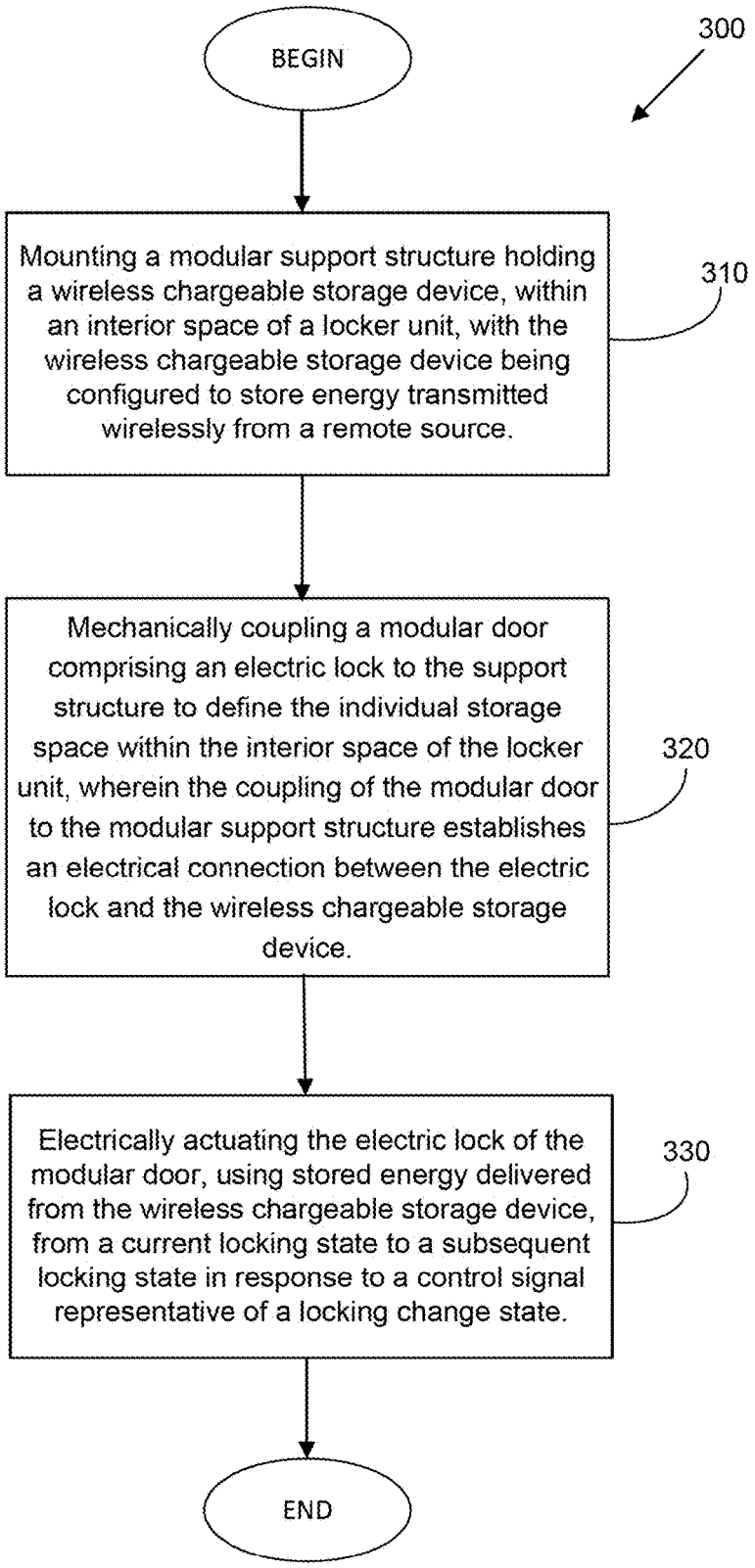
FIG. 3 is a flowchart of an example procedure to control access to an individual storage space.

With reference next to FIG. 3, a flowchart of an example procedure 300 to control access to an individual storage space is shown. The procedure 300 includes mounting 310 a modular support structure holding a wireless chargeable storage device (such as the receiver 130 depicted in FIG. 1) within an interior space of a locker unit, with the wireless chargeable storage device being configured to store energy transmitted wirelessly from a remote source. The remote source may be a high power wireless transmitter, such as the transmitter 150, which may also be used to communicate with individual communications modules deployed, or incorporated, within individual locker spaces assembled in a locker/storage unit. In some embodiments, mounting the modular support structure may include mounting a modular side wall (such as the side wall 120 illustrated in FIG. 1) adjustably mountable at one of a plurality of locations within the interior space of the locker unit, with the individual storage space being bounded by the modular side wall. As noted, the adjustable mounting of a modular side wall may be achieved by use of a plurality of grooves, tracks, or rails, deployed within a container structure (e.g., the cabinet like structure 110 of FIG. 1) which at a bare state (before any modular parts are mounted thereon) may be an open container (that may be divided into compartments through pre-installed shelves), with the grooves, tracks, or rails being defined or disposed on the shelves, a back wall of the structure, or elsewhere. To assemble a locker, a modular side wall can be fitted, for example, into a groove or a rail, and mechanically secured to the main container structure (e.g., via fastening implements such as screws, bolts, etc.)

With continued reference to FIG. 3, the procedure 300 further includes mechanically coupling 320 a modular door comprising an electric lock to the support structure to define the individual storage space within the interior space of the locker unit, with the coupling of the modular door to the modular support structure establishing (e.g., via an interface such as the interface 124 illustrated in FIG. 1) an electrical connection between the electric lock and the wireless chargeable storage device. This electrical connection establishes a path to provide the electrical energy (stored on a wireless power storage device, such as the receiver 130 of FIG. 1) to actuate an electric lock provided on the modular door coupled to the side wall. It is noted that in some embodiments the modular door may be provided with a mechanical lock requiring actuation by a mechanical key. As discussed herein, the various modular parts, including the modular door and the modular wall, may be selected from an inventory that includes parts of different sizes, parts with different locks, parts with different styles or colors, etc., thus giving an installer (which may be a user that not only rents the locker space, but can assemble the locker by selecting the modular parts that are mounted into the structure 110) wide latitude in customizing the locker being assembled.

As additionally shown in FIG. 3, the procedure 300 includes electrically actuating 330 the electric lock of the modular door, using stored energy delivered from the wireless chargeable storage device, from a current locking state (e.g., locked or unlocked) to a subsequent locking state (e.g., unlocked or locked) in response to a control signal representative of a locking change state. In some embodiments, electrically actuating the electric lock of the modular door may include electrically actuating one of, for example, an electromagnetic lock operable in a fail-secure configuration, an electromagnetic lock operable in a fail-safe configuration, an electrical strike lock operable in the fail-secure configuration, and/or an electrical strike lock operable in the fail-safe configuration.

In some implementations, controlling the actuation of the electric lock may be based on data received in a wireless communication from a wireless device (such as a personal mobile device of a user that rented locker space assembled using the modular parts described herein). Thus, the procedure 300 may further include receiving a wireless communication message from at least one remote device, determining whether the wireless communication message includes a valid access authorization to access the individual storage space, and electrically actuating the electric lock in response to a determination that the received wireless communication message includes the valid access authorization. For example, the access authorization code may be a code assigned to a user wishing to purchase/rent storage space (of some desired dimensions, or meeting some other requirements), which the user may specify via a pay station located in proximity to the locker unit, or via a mobile application (app) that links the user (e.g., via a WLAN or WWAN communication protocol) to a managing server (such as the server 174 of FIG. 1) that can assign, e.g., upon payment by the user through a secured payment process, a particular locker. The server (or pay station, or some other controlling device) can communicate the access/authorization code to the user's mobile device, as well as communicate the authorization code to the locker assigned to the user. For example, a remote server may send a wireless message receivable by a communication module implemented on the individual control and communication circuitry of the locker (e.g., realized on a wireless power storage device 130), or alternatively receivable by a central node such as the node 150 (whose functionality includes providing the RF power used to charge the chargeable devices of the modular parts on which harvested RF energy is stored). The communication between the device 150 and individual communication modules of the modular parts may be performed using near-range communication protocols, such as Bluetooth protocol, BLE protocol, an RFID protocol, etc., as well as medium and long-range protocols (e.g., WLAN and WWAN protocols).

When the user approaches the locker unit, the user may send, e.g., via a short-range communication link, a wireless message that includes data representative of the access authorization code. A receiving communication module may demodulate and decode the message to extract the code (as well as other data), and based on the extracted code determines if the code matches the code stored in the respective controller's memory. The user may know which locker has been assigned to him/her, and may therefore approach the locker so as to be within communication range of the locker; alternatively, the user may not know which locker was assigned, and may therefore broadcast a wireless message to cause the correct locker to have its electric lock actuated and unlocked, or to signal (through visual cues) which locker was assigned to the user.

In some embodiments, a determination of whether to actuate the electric lock may be based on other factors. For example, as noted, the determination to actuate (and thus open or lock a locker) may be based on whether the locker holds an item that is associated with the user. Such a determination may be achieved by equipping items deposited within a locker with respective RFID tags that are associated with identifiers corresponding to the depositing user. When a user wishes to open a locker, the wireless message sent to the communication module of the particular locker may also include data representative of the RFID identification data associated with a deposited item. An RFID reader (which may be implemented as part of the circuitry associated with the modular parts of the locker) may send an RFID interrogation/probing signal, which may (if an item deposited within the locker includes an RFID tag configured to respond to the interrogation signal) cause the RFID tag to send a reply RFID message. If the identifier associated with the reply message matches the identifier provided by the user through the wireless message directed to the locker's communication module, the item is deemed to belong to the user, resulting in actuation of the locker (assuming that the access authorization codes, if any, also match). Thus, in such embodiments, electrically actuating the electric lock may further include electrically actuating the electric lock in response to a further determination that an item inside the individual storage space transmitted an RFID identification code matching an item code included with the wireless communication message from the at least one remote devices.

Figure 4:
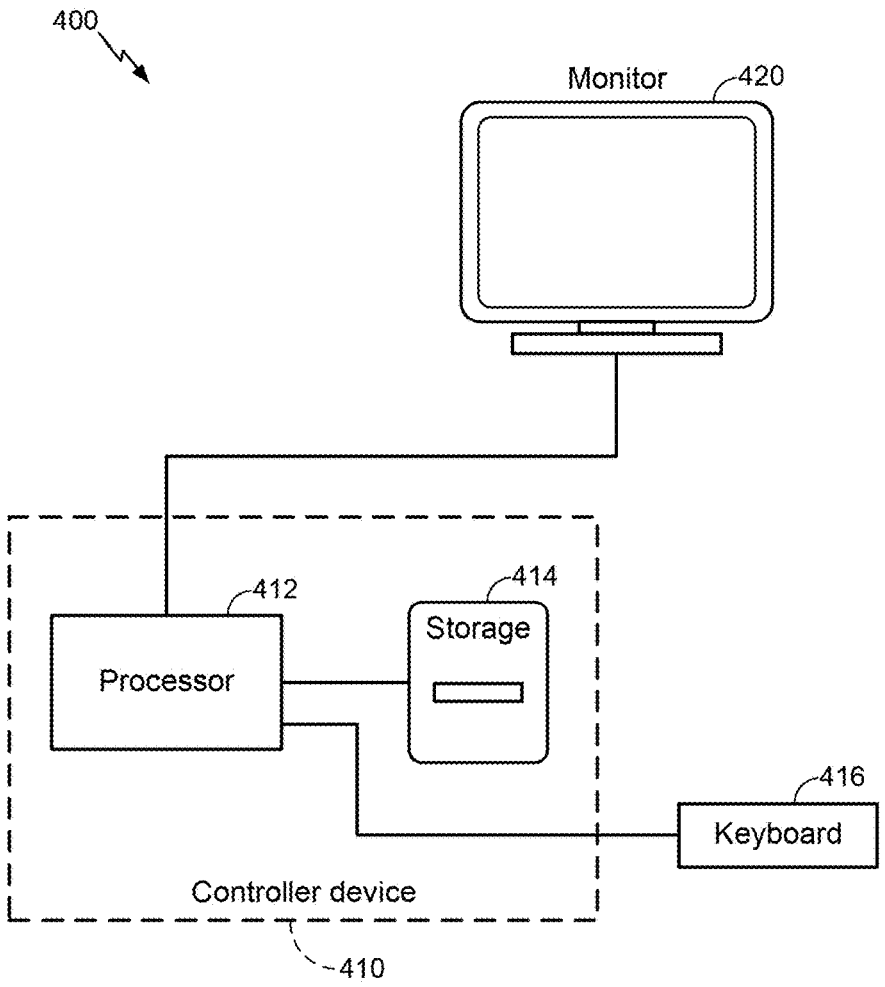
FIG. 4 is a schematic diagram of a processor-based device that may be used to implement, at least partly, some of various devices and nodes depicted in FIGS. 1 and 2.

Performing the various operations described herein may be facilitated by a processor-based computing system. Particularly, each of the various systems/devices described herein may be implemented, at least in part, using one or more processing-based devices such as a computing system. With reference to FIG. 4, a schematic diagram of a computing system 400 is shown. The computing system 400 includes a processor-based device 410 such as a personal computer, a specialized computing device, and so forth, that typically includes a central processor unit 412. In addition to the CPU 412, the system includes main memory, cache memory and bus interface circuits (not shown). The processor-based device 410 may include a mass storage element 414, such as a hard drive or flash drive associated with the computer system. The computing system 400 may further include a keyboard, or keypad, or some other user input interface 416, and a monitor 420, e.g., an LCD (liquid crystal display) monitor, that may be placed where a user can access them.

The processor-based device 410 is configured to facilitate, for example, the implementation of operations to control access to individual storage spaces (such as locker spaces implemented through assembly of modular parts that hold control and access circuitry such as those depicted in FIG. 1 and, e.g., wireless communication modules, electric locks, wireless power storage devices, etc.) The storage device 414 may thus include a computer program product that when executed on the processor-based device 410 causes the processor-based device to perform operations to facilitate the implementation of the above-described procedures and operations. The processor-based device may further include peripheral devices to enable input/output functionality. Such peripheral devices may include, for example, a CD-ROM drive and/or flash drive (e.g., a removable flash drive), or a network connection (e.g., implemented using a USB port and/or a wireless transceiver), for downloading related content to the connected system. Such peripheral devices may also be used for downloading software containing computer instructions to allow general operation of the respective system/device. Alternatively and/or additionally, in some embodiments, special purpose logic circuitry, e.g., an FPGA (field programmable gate array), an ASIC (application-specific integrated circuit), a DSP processor, etc., may be used in the implementation of the system 400. Other modules that may be included with the processor-based device 410 are speakers, a sound card, a pointing device, e.g., a mouse or a trackball, by which the user can provide input to the computing system 400. The processor-based device 410 may include an operating system, e.g., Windows XP® Microsoft Corporation operating system. Alternatively, other operating systems could be used.

Computer programs (also known as programs, software, software applications or code) include machine instructions for a programmable processor, and may be implemented in a high-level procedural and/or object-oriented programming language, and/or in assembly/machine language. As used herein, the term "machine-readable medium" refers to any non-transitory computer program product, apparatus and/or device (e.g., magnetic discs, optical disks, memory, Programmable Logic Devices (PLDs)) used to provide machine instructions and/or data to a programmable processor, including a non-transitory machine-readable medium that receives machine instructions as a machine-readable signal.

Some or all of the subject matter described herein may be implemented in a computing system that includes a back-end component (e.g., as a data server), or that includes a middleware component (e.g., an application server), or that includes a front-end component (e.g., a client computer having a graphical user interface or a Web browser through which a user may interact with an embodiment of the subject matter described herein), or any combination of such back-end, middleware, or front-end components. The components of the system may be interconnected by any form or medium of digital data communication (e.g., a communication network). Examples of communication networks include a local area network ("LAN"), a wide area network ("WAN"), and the Internet.

The computing system may include clients and servers. A client and server are generally remote from each other and typically interact through a communication network. The relationship of client and server generally arises by virtue of computer programs running on the respective computers and having a client-server relationship to each other.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate in the context of the systems, devices, circuits, methods, and other implementations described herein.

As used herein, including in the claims, "or" as used in a list of items prefaced by "at least one of" or "one or more of" indicates a disjunctive list such that, for example, a list of "at least one of A, B, or C" means A or B or C or AB or AC or BC or ABC (i.e., A and B and C), or combinations with more than one feature (e.g., AA, AAB, ABBC, etc.). Also, as used herein, unless otherwise stated, a statement that a function or operation is "based on" an item or condition means that the function or operation is based on the stated item or condition and may be based on one or more items and/or conditions in addition to the stated item or condition.

Although particular embodiments have been disclosed herein in detail, this has been done by way of example for purposes of illustration only, and is not intended to be limiting with respect to the scope of the appended claims, which follow. In particular, it is contemplated that various substitutions, alterations, and modifications may be made without departing from the spirit and scope of the invention as defined by the claims. Other aspects, advantages, and modifications are considered to be within the scope of the following claims. The claims presented are representative of the embodiments and features disclosed herein. Other unclaimed embodiments and features are also contemplated. Accordingly, other embodiments are within the scope of the following claims.

What is claimed is:

1. A lock assembly to control access to an individual storage space, the lock assembly comprising:

a wireless chargeable storage device to store energy transmitted wirelessly from a remote source;

a modular side wall configured to hold the wireless chargeable storage device, the modular side wall adjustably mountable at one of a plurality of locations within an inner space of a container structure to define the individual storage space with adjustable-dimensions that depend on a selected location from the plurality of locations within the inner space of the container structure at which the adjustably mountable modular side wall, bounding the individual storage space, was mounted; and an electric lock in electrical communication with the wireless chargeable storage device, the electric lock configured to be electrically actuated, using stored energy delivered from the wireless chargeable storage device, from a current locking state to a subsequent locking state in response to a control signal representative of a locking change state.

2. The lock assembly of claim 1, further comprising:

a modular door on which the electric lock is mounted, wherein the modular door is physically coupled to the modular side wall via a physical coupler, the physical coupler comprising an interfacing circuit to electrically couple the wireless chargeable storage device to the electric lock.

3. The lock assembly of claim 1, wherein the modular side wall is coupled to a modular door that further bounds the individual storage space.

4. The lock assembly of claim 1, further comprising:

a communication module to communicate with remote devices, the communication module configured to receive a communication message from at least one of the remote devices; and a controller configured to:

determine, based on the wireless communication message, whether the wireless communication message includes a valid access authorization to access the individual storage space, and cause electric actuation of the electric lock in response to a determination that the received communication message includes the valid access authorization.

5. The lock assembly of claim 4, wherein the controller configured to cause the electric actuation of the electric lock is configured to:

cause the electric actuation of the electric lock in response to the determination that the received communication message includes the valid access authorization and a further determination that an item inside the individual storage space transmitted an RFID identification code matching an item code included in the wireless communication message from the at least one of the remote devices.

6. The lock assembly of claim 5, wherein the communication module further comprises an RFID reader configured to:

send a probe signal in response to the determination that the received communication message includes the item code included in the wireless communication message from the at least one of the remote devices; and determine that a received RFID reply communication responsive to the probe signal matches the item code.

7. The lock assembly of claim 4, wherein the communication module comprises a wireless communication module configured to receive one or more of: a wireless short-range communication signal, a wireless medium range communication signal, or a wireless long-range communication signal.

8. The lock assembly of claim 7, wherein the wireless communication module is configured to receive one or more of: a Bluetooth® signal, a Bluetooth-Low-Energy® signal, an RFID signal, a ZigBee signal, a WLAN signal, or a WWAN signal.

9. The lock assembly of claim 4, wherein the controller configured to cause the electric actuation of the electric lock is configured to:

cause the electric actuation of the electric lock in response to a further determination that the received communication message was transmitted from a transmitter location approximately matching a location of the lock assembly.

10. The lock assembly of claim 1, wherein the electric lock comprises one or more of: an electromagnetic lock operable in a fail-secure configuration, or an electrical strike lock operable in the fail-secure configuration.

11. The lock assembly of claim 1, wherein the electric lock comprises one or more of: an electromagnetic lock operable in a fail-safe configuration, or an electrical strike lock operable in the fail-safe configuration.

12. A locker unit comprising:

multiple modular side walls that each comprises a respective wireless chargeable storage device to store energy transmitted wirelessly from one or more remote sources and is adjustably mountable at one of a plurality of locations within an inner space of the locker unit to define an individual storage space with adjustable-dimensions that depend on a selected location from the plurality of locations within the inner space of the locker unit at which the adjustably mountable modular side wall, bounding the individual storage space, was mounted; and a plurality of individually controlled electric locks that are each in electrical communication with the wireless chargeable storage device of a respective one of the multiple modular side walls, each of the plurality of the individually controlled electric locks configured to be electrically actuated, using stored energy delivered from the wireless chargeable storage device of the respective one of the multiple modular side walls, from a current locking state to a subsequent locking state in response to a respective control signal representative a locking change state;

wherein the multiple modular side walls define, in part, individually accessible storage spaces of the locker unit.

13. The locker unit of claim 12, further comprising:

modular doors on which respective ones of the plurality of individually controlled electric locks are mounted, wherein the modular doors are physically coupled to respective ones of the multiple modular support structure via respective couplers, the couplers comprising interfacing circuits to electrically couple the wireless chargeable storage devices to the respective ones of the plurality of individually controlled electric locks.

14. The locker unit of claim 12, wherein the multiple modular support structures each comprises a side wall adjustably mountable at one of a plurality of locations within an inner space of a container structure to define a respective one of the individually accessible storage spaces of the locker unit.

15. The locker unit of claim 12, wherein each of the individually accessible storage spaces is associated with a communication module to communicate with remote devices, the communication module configured to receive a communication message from at least one of the remote devices, and wherein each of the individually accessible storage spaces is further associated with a controller configured to:

determine, based on the wireless communication message, whether the wireless communication message includes a valid access authorization to access the respective individual storage space, and cause electric actuation of the respective one of the plurality of individually controlled electric locks in response to a determination that the received communication message includes the valid access authorization.

16. A method to control access to an individual storage space, the method comprising:

mounting a modular side wall within an interior space of the locker unit, the modular side wall being adjustably mountable at one of a plurality of locations within the interior space of a locker unit to define the individual storage space with adjustable-dimensions that depend on a selected location from the plurality of locations within the interior space of the locker unit at which the adjustably mountable modular side wall, bounding the individual storage space, was mounted, with the modular side wall holding a wireless chargeable storage device configured to store energy transmitted wirelessly from a remote source;

mechanically coupling a modular door comprising an electric lock to the modular side wall to define the individual storage space within the interior space of the locker unit, wherein the coupling of the modular door to the modular side wall establishes an electrical connection between the electric lock and the wireless chargeable storage device; and electrically actuating the electric lock of the modular door, using stored energy delivered from the wireless chargeable storage device, from a current locking state to a subsequent locking state in response to a control signal representative of a locking change state.

17. The method of claim 16, further comprising:

receiving a wireless communication message from at least one remote device;

determining whether the wireless communication message includes a valid access authorization to access the individual storage space; and electrically actuating the electric lock in response to a determination that the received wireless communication message includes to the valid access authorization.

18. The method of claim 17, wherein electrically actuating the electric lock further comprises:

electrically actuating the electric lock further in response to a further determination that an item inside the individual storage space transmitted an RFID identification code matching an item code included with the wireless communication message from the at least one remote devices.

19. The method of claim 17, wherein receiving the wireless communication message comprises:

receiving one or more of: a Bluetooth® signal, a Bluetooth-Low-Energy® signal, an RFID signal, a ZigBee signal, a WLAN signal, or a WWAN signal.

20. The method of claim 16, wherein electrically actuating the electric lock of the modular door comprises:

electrically actuating one of: an electromagnetic lock operable in a fail-secure configuration, an electromagnetic lock operable in a fail-safe configuration, an electrical strike lock operable in the fail-secure configuration, or an electrical strike lock operable in the fail-safe configuration.

* * * * *